US005664412A

United States Patent [19]

Overton

[11] Patent Number: 5,664,412

[45] Date of Patent: Sep. 9, 1997

[54] VARIABLE GEOMETRY AIR-FUEL INJECTOR

[75] Inventor: Dennis L. Overton, Bristol, Great Britain

[73] Assignee: Rolls-Royce plc, London, United Kingdom

[21] Appl. No.: 621,209

[22] Filed: Mar. 22, 1996

[30] Foreign Application Priority Data

Mar. 25, 1995 [GB] United Kingdom ..... 9506116

[51] Int. Cl.[6] ..... F23R 3/26

[52] U.S. Cl. ..... 60/39.23; 60/748

[58] Field of Search ..... 60/39.23, 39.29, 60/748

[56] References Cited

U.S. PATENT DOCUMENTS

| | | | |
|---|---|---|---|
| 4,726,182 | 2/1988 | Barbier et al. | 60/39.23 |
| 4,766,722 | 8/1988 | Bayle-Laboure et al. | 60/39.23 |
| 5,333,459 | 8/1994 | Berger . | |
| 5,373,693 | 12/1994 | Zarzalis et al. | 60/39.23 |
| 5,398,495 | 3/1995 | Ciccia et al. . | |

FOREIGN PATENT DOCUMENTS

WO 92/17736 10/1992 Germany .

*Primary Examiner*—Louis J. Casaregola
*Attorney, Agent, or Firm*—Oliff & Berridge

[57] ABSTRACT

A combustion chamber head assembly consists of an annular, domed combustor head separated on its downstream side from the combustion region by an annular bulkhead. A number of fuel injector means are spaced apart around the head assembly and extend through to supply fuel-air mixture to the combustor region through apertures in the bulkhead. Fuel is supplied by a nozzle at the upstream end of a mixing region. Air is admitted to this region through a variable geometry airflow arrangement comprising several airflow passage disposed concentrically around the nozzle, the passages may include swirl vanes. A portion of the wall surrounding the mixing region is axially translatable to close-off one of the air inlet passages and direct air from the mixing region into the cavity enclosed by the combustor head and bulkhead from where it escapes into the combustion region through air-only apertures in the bulkhead wall.

8 Claims, 3 Drawing Sheets

Figure 1:
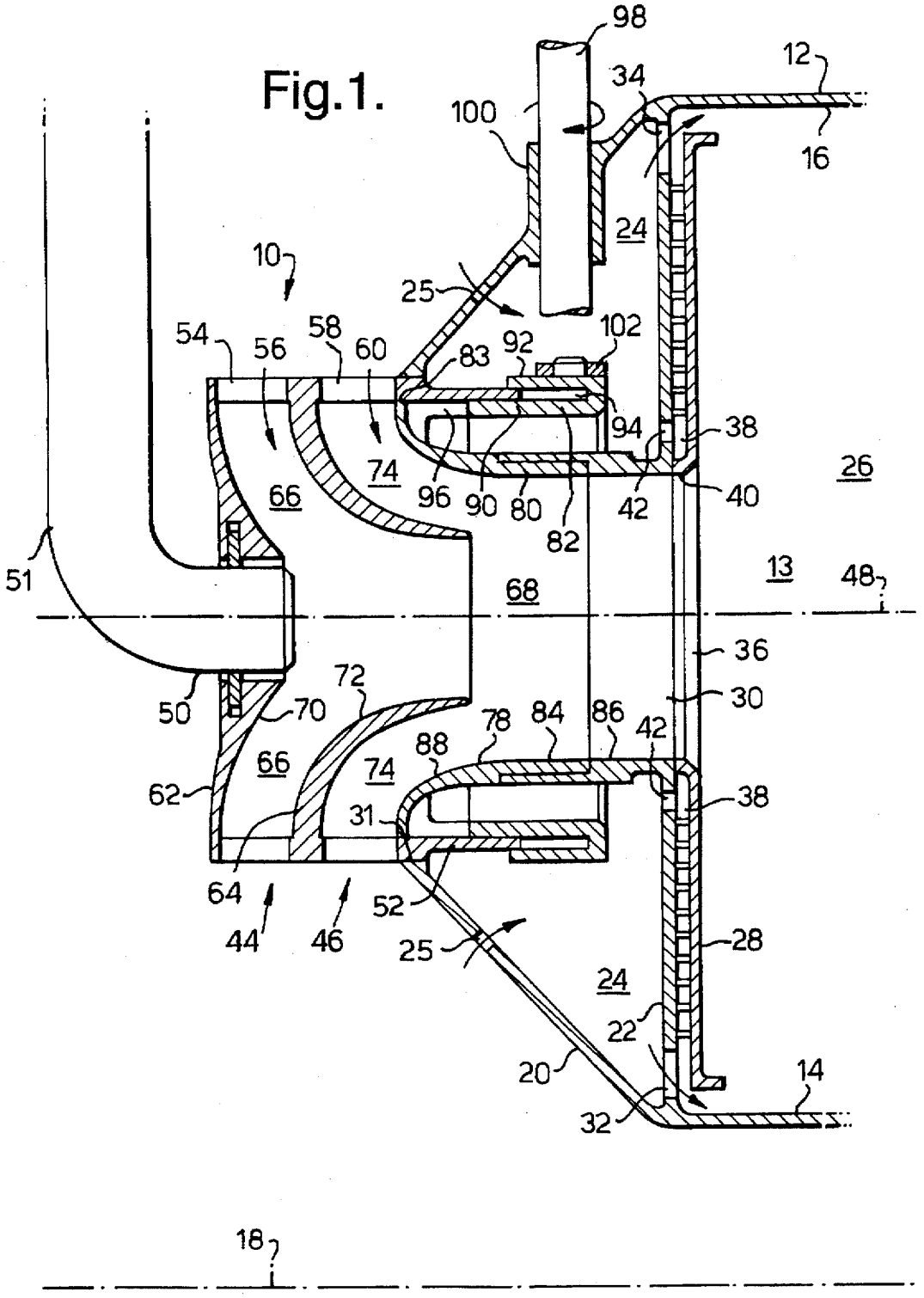

98
12
34
100
16
24
10
25
54
56
58
60
83
92
102
94
38
26
74
96
90
80
42
40
66
82
51
13
48
68
36
72
30
50
70
78
84
86
42
88
66
74
62
38
31
64
52
44
46
25
28
24
22
20
14
32
18

VARIABLE GEOMETRY AIR-FUEL INJECTOR

This invention relates to a combustion chamber head assembly with variable geometry fuel injector means for a gas turbine engine combustor. In particular the invention concerns a fuel injector having airflow control means operative to vary combustor airflow in accordance with engine operating conditions.

Fuel injectors used in the combustion systems of modern gas turbine engines are usually of the air-spray (or air-blast) atomiser type. These devices are designed to bring together controlled amounts of air and fuel to achieve a well distributed air-fuel mixture for engine combustor entry at a desired air-fuel ratio. Fuel atomisation is achieved by exposing the fuel to a high velocity airflow supplied from the engine compressor. It is generally preferred that the airflow is caused to swirl to increase the relative velocity between the air and the fuel prior to combustor entry. This provides for more efficient burning with the resultant effect of reduced combustor emissions.

In known arrangements swirl vanes are provided to create the necessary swirl effect. The vanes are arranged in arrays disposed around a central fuel delivery nozzle and/or coaxially with a ring of fuel discharge apertures. The vanes may define radially inflowing air swirl devices or alternatively axial flow devices. In both arrangements the airflow through the injector is determined by the effective flow area of the airflow passages between the vanes.

The selection of the portion of combustor air that is to enter the combustor through the swirl devices is often a compromise between desired combustor performance at full power conditions, where it is preferable to operate with a relatively weak air-fuel mixture to minimise smoke emissions, and desired combustor performance at low power conditions where there is a requirement to avoid weak extinction. With fixed geometry devices there is a limit to the operational range of the injectors, and in order to obtain satisfactory performance at low power conditions it has been the practice to limit injector air-fuel ratios at high power conditions.

Optimisation of fuel injector airflow has become more difficult in recent years due to the ever increasing range of engine cycle air-fuel ratios. One approach to this problem has been the development of staged combustors. Typically these combustors include a dedicated pilot stage combustion zone which is optimised for low emission combustion at low power low temperature settings, and a main stage combustion zone which is optimised for low emission combustion at high power high temperature settings. Fuel is fed to dedicated pilot stage fuel injectors during low power operation, and additionally to dedicated main stage injectors during high power operation. During low power operation fuel to the main stage injectors is cut off and all fuel goes to the pilot resulting in improved combustor stability. The drawback however with staged combustors is that they add to the overall weight and mechanical complexity of the engine.

Another approach has been to control the air flow through the injectors by making the injectors variable geometry. A number of variable geometry fuel injectors have been proposed wherein the airflow through the injector is controlled by a movable control ring or sleeve disposed about the outer periphery of the vanes. Apertures formed in the control ring (or sleeve) cooperate with the airflow passages between the vanes in such a manner to regulate the airflow entering the injector through the vanes. An example of an injector of this type is disclosed in International Patent Application WO92/17736. The injector disclosed in this reference comprises a pair of axially adjacent swirl devices, one of which is of the variable geometry type having an axially translatable sleeve element disposed about it's outer periphery, and one which is fixed.

A problem associated with this and other variable geometry devices is that as the airflow through the injector is restricted there is a resultant increase in combustion chamber pressure loss. The effect of this is to cause the engine compressor to operate closer to a surge condition and the airflow through engine compressor bleed systems to increase. In arrangements where the injectors are provided with one or more fixed geometry swirl devices in addition to at least one variable geometry device, as in WO92/17736 above, there is an additional problem of the airflow through the fixed geometry device increasing as the combustion pressure loss increases. This has this effect of negating, at least in part, the airflow reduction intended.

It is an objective of the present invention therefore to provide a variable geometry fuel injector which overcomes the problems of the prior art. In particular the invention has for an objective a variable geometry fuel injector which has a combustion chamber pressure loss characteristic consistent with that of a fixed geometry device.

According to the invention there is provided a combustion chamber head assembly with variable geometry fuel injector means for a gas turbine engine, comprising a combustor head defining an enclosed volume separated on its downstream side from a combustion region by an endwall which is pierced by a multiplicity of apertures including at least one fuel-air mixture aperture and a plurality of air-only apertures, and at least one fuel injector assembly including means defining a fuel-air mixing region opening through the fuel-air mixture aperture into the combustion region, a fuel nozzle which, in operation, sprays fuel into the fuel-air mixing region, and airflow control means having a first flow passage for admitting air into the fuel-air mixing region and a second passage including a movable diverter member for selectively diverting air entering the second passage to exit either into the mixing region or via the enclosed combustor head volume into the plurality of air-only apertures whereby airflow into the mixing region may be varied.

Preferably in the closed position the air passing through the vanes is directed into a cavity disposed on the upstream side of the combustion chamber.

Preferably the cavity is divided from the combustion chamber by a combustion chamber endwall, and the endwall is apertured to provide the air-fuel and air-only outlets.

Preferably the air-fuel and air-only outlets are spaced apart so that air entering the combustion chamber through the air-only outlet or outlets has substantially no effect on the combustion chamber air-fuel ratio immediately downstream of the air-fuel outlet.

The flow control means may comprise an axially translatable sleeve which co-operates with a coaxial annular flange member to define an annular flow boundary between the air-fuel mixing region and the cavity.

Preferably the sleeve comprises an inner annular wall member which forms part of the flow boundary, and an adjoining outer annular wall which forms part of a sleeve valve arrangement for directing air exiting the vanes to the alternative air-fuel and air-only flow outlets.

The outer wall member may be provided with a plurality of circumferentially spaced apertures through which air exiting the vanes passes as the sleeve is progressively moved to restrict the air entering the mixing region.

Figure 2:
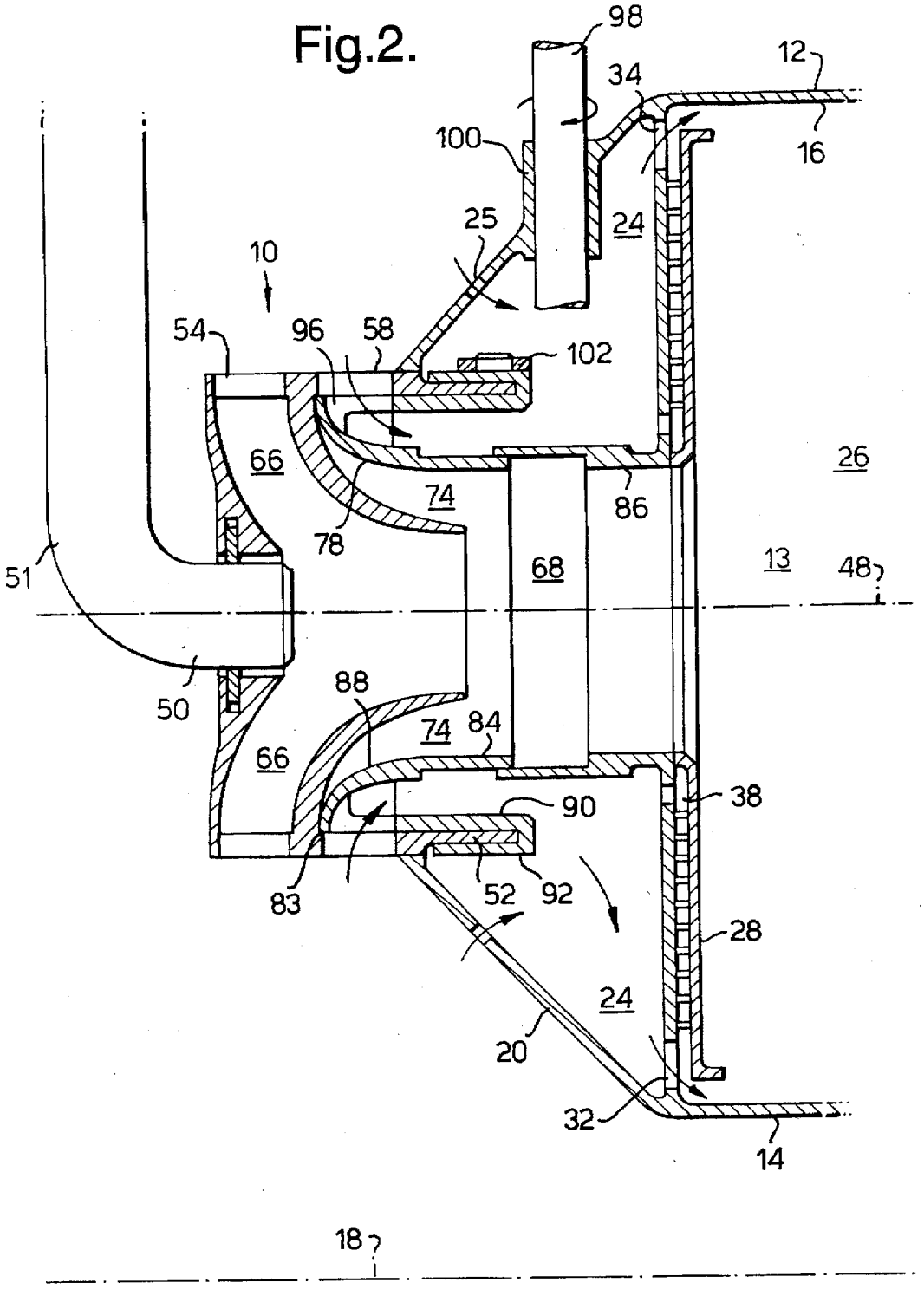
Figure 3:
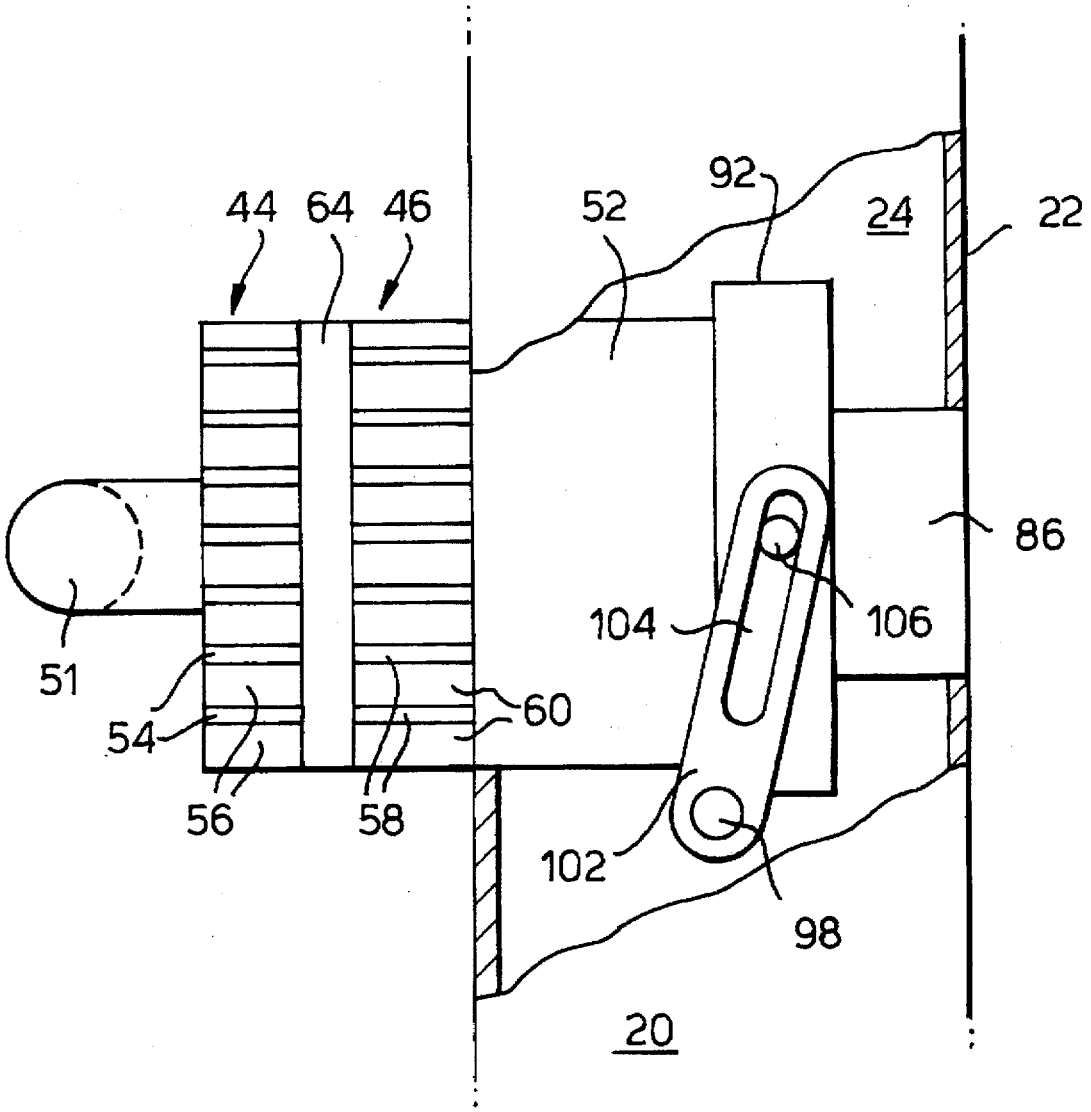

The invention will now be described in greater detail, by way of example only, with reference to the accompanying drawings in which:

FIG. 1 is a partial, longitudinal sectional view of a gas turbine engine combustor having a variable air-fuel injector of the present invention in a high power configuration, FIG. 2 shows the injector of FIG. 1 configured for low power engine operation, and FIG. 3 is a part cut-away view of the injector of FIG. 1 in the direction of A revealing details of an injector actuating mechanism.

With reference to FIG. 1, there is shown, a variable geometry air-fuel injector 10 positioned at the upstream end of a gas turbine engine combustor 12. A plurality of such injectors are circumferentially spaced around the combustor 12 for delivery of an air-fuel mixture to a primary combustion zone 13. FIG. 1 shows the sectional detail of one injector, all the injectors in the system being identical. In FIG. 1 the surrounding engine detail, such as elements of the engine compressor and turbine which lie adjacent the combustor, is omitted for clarity.

In use, a portion of incoming air from the engine compressor (not shown, but to the left of the drawing in FIG. 1) is directed to the injectors 10 where it is mixed with fuel to form a vaporised air-fuel mixture. This mixture enters the upstream primary combustion zone 13 where it is burnt. The combustion gases then enter a downstream dilution or secondary zone (not shown) where additional air from the engine compressor is added prior to expansion through the engine turbine (also not shown, but to the right of the drawing in FIG. 1).

The combustor shown is of a generally conventional configuration and includes a pair of radially spaced annular sidewall members 14 and 16 which are coaxially disposed about a main engine axis 18. The sidewalls are connected at their upstream end by means of an aerodynamically shaped combustor head portion 20 and an upstream combustor bulkhead 22. The bulkhead extends radially between the sidewalls to provide an annular partition between an upstream air cavity 24 and a downstream combustion chamber region 26.

A protective heatshield 28 is mounted on the downstream face of the bulkhead 22 to provide thermal shielding from combustion temperatures. The heatshield has an annular configuration made up of a plurality of abutting heatshield segments which are bolted in abutting relationship to the bulkhead 22. The segments, which are of substantially identical form, extend both radially towards the inner and outer walls 14 and 16 of the combustor, and circumferentially towards adjacent segments to provide a fully annular shield.

The bulkhead is provided with a plurality of circumferentially spaced apertures 30 for air-fuel entry to the combustion chamber 26, and a like plurality of apertures 32 and 34 for air-only entry. The air-fuel apertures 30 are positioned mid-way between the inner and outer combustor walls 14 and 16 and align with a corresponding series of apertures 31 formed in the upstream head portion 20. The air-only apertures 32 and 34 lie adjacent the combustor walls at the radially inner and outer bulkhead extremities. The heatshield segments, which are each associated with an adjacent one of the air-fuel apertures 30, are similarly provided with air-fuel entry apertures 36 which align with the bulkhead apertures 30 in the combustor assembly. The segments are each spaced a short distance from the bulkhead to create a series of under-segment chambers 38. Each segment is spaced from the bulkhead by an annular flange 40 formed around the air-fuel aperture 36. The chambers 38 are each adapted to receive a supply of cooling air for tile cooling through a further series of bulkhead apertures 42 formed around the air-fuel entry apertures 30. The cavity 24 is vented at a number of positions 25 to receive a portion of the compressor airflow for supply to the under tile chambers 38.

Each injector has a generally cylindrical configuration and comprises a pair of axially spaced air swirl devices 44 and 46 disposed about a main injector axis 48, a central fuel delivery nozzle 50 aligned substantially along that axis, and an axially extending downstream cylindrical flange portion 52 which locates the injector in a respective one of the combustor apertures 31. The fuel delivery nozzle 50 is positioned at the distal end of a fuel delivery arm 51 suspended from surrounding engine casing structure (not shown).

The first of the swirl devices 44 comprises a plurality of circumferentially spaced swirl vanes 54 which define a first series of radially inflowing air-inlet passages 56. The second device 46 comprises a like plurality of swirl vanes 58 which define an adjacent series of inlet passages 60. As FIG. 1 shows, the first and second swirl devices define first and second airflow inlets to a central air-fuel mixing region 68 downstream of the fuel nozzle 50.

The first series of vanes 54 are disposed between an upstream injector end wall 62 and a profiled annular flow divider 64. The second set of vanes 58 are disposed in a similar manner between the flow divider 64 and the upstream extremity of the cylindrical flange 52.

The end wall 62 and flow divider 64 define opposing sides of a common flow path 66 which extends from the vane inlet passages 56 to the air-fuel mixing region 68. The flow path 66 has an arcuate profile which is determined by the correspondingly shaped interior end wall and upstream flow divider surfaces 70 and 72. The shape of the flow path 66 is such that the air entering the injector through the vanes 56 is turned through 90 degrees before entering the air-fuel mixing region 68. An arcuate flow path 74 is similarly defined on the downstream side of the flow divider 64. This flow path extends in a similar manner between the vanes 58 and the air-fuel mixing region 68. The shape of the flow path 74 corresponds to that of the adjacent flow path 66 so that air entering the injector through the vanes 56 is caused to exit in the direction of the injector axis 48.

In accordance with the invention the downstream boundary of the injector flow path 74 is provided by an upstream portion of a axially moveable flow control ring 78.

The flow control ring comprises a pair of radially spaced annular wall members 80 and 82 which are joined at their respective upstream ends along a common side edge 83. The inner wall member 80 defines an annular airflow boundary between the air-fuel mixing region 68 and the surrounding airflow cavity 24. The inner wall 80 includes a downstream cylindrical wall section 84 which has a stepped outer surface for cooperation with an overlapping portion of a cylindrical flange 86 extending from the bulkhead aperture 30, and a profiled upstream portion 88 which is shaped in accordance with the downstream surface of the flow divider 64. The outer wall 82 includes a main cylindrical portion 90 which lies adjacent the injector flange 52 and a radially spaced cylindrical flange 92. The flange 92 is positioned at the downstream end of the cylinder in coaxial spaced relation so as provide an annular recess 94 for receiving the injector flange 52. The recess 94 provides for location of the control ring with respect to the injector body and in addition provides a guide for the movable ring along the injector axis.

A plurality of circumferentially spaced airflow apertures 96 are distributed around the cylinder 90 immediately downstream of the adjoining side edge 83. These apertures form the side openings of a sleeve valve arrangement which is operative to direct the flow exiting the vane passages 60 to selective alternative regions.

The control ring 78 which forms the movable part of the sleeve valve arrangement is connected to a rotatable input shaft 98. The shaft extends radially outward from the injector 10 through a bush 100 located in the combustor head 20. Preferably the shaft extends in the radial direction of the engine and is connected at it's radially outermost end to a unison ring (not shown) linking all the injectors 10 for coordinated operation.

As can best been seen from FIG. 3 the radially innermost end of the shaft 98 is attached to one end of a actuating lever 102. The lever has a elongate slot 104 which is adapted to receive an upstanding pin 106 secured to the cylindrical flange 92 at the 12 O'clock position of the ring. The shaft is offset from the pin so that as the shaft rotates the control ring is caused to translate.

The control ring is movable between the positions shown FIGS. 1 and 2. In the position of FIG. 1 the injector is configured for high power engine operation. The control ring 78 is positioned as far rearward as the arrangement will allow. The upstream edge of the ring is aligned with the downstream extremity of the downstream injector vane passages 60. The apertures 96 at the upstream end of the ring are disposed adjacent the cylindrical flange 52. The ring effectively seals the cavity 24 from the airflow through the vanes. In this position all the air passing through the vane passages 56 and 60 enters the mixing region 68 for discharge as an air-fuel mixture to the primary combustion region 13.

In the position of FIG. 2 the control ring 78 has been moved to the position shown by rotation of the actuation shaft 98. In this position the injector is configured for low power engine operation. The forward edge of the control ring is now positioned adjacent the flow divider 64. Translation of the ring causes the airflow apertures 92 to align with the vane passages 60. This causes the airflow through the downstream passages 60 to flow into the cavity region 24 for combustor entry at airflow entry apertures 32 and 34. The movement of the ring to this position effects a reduction in the overall air-fuel ratio of the air and fuel mixture entering the combustion zone through the air-fuel openings 30,36. The portion of air entering through the vanes 58 is diverted to the cavity 24 and the only airflow to the mixing region 68 is that entering through the upstream vane passages 56.

The injector described provides for greater operational flexibility since there is little or no change in effective injector air inlet area during flow modulation. The inlet flow area presented to the incoming compressor airflow by the vane passages 56 and 60 remains constant regardless of control ring position. The only effect the control ring has is to alter the proportion of the incoming air which enters the air-fuel mixing region. From the foregoing it will be appreciated that the pressure loss characteristic of the gas turbine engine combustor described will correspond to that of a conventional combustor equipped with fixed geometry air-fuel injection devices. As previously mentioned this provides for greater airflow control and also engine operational stability.

I claim:

1. A combustion chamber head assembly with a variable geometry fuel injector for a gas turbine engine, comprising a combustor head defining an enclosed combustor head volume separated on its downstream side from a combustion region by an endwall which is pierced by a multiplicity of apertures including at least one fuel-air mixture aperture and a plurality of air-only apertures, at least one fuel injector assembly defining a fuel-air mixing region opening through the fuel-air mixture aperture into the combustion region, the at least one fuel injector assembly comprising a plurality of concentric rings which define a first inner annular air passage and a second outer annular air passage, a fuel nozzle located axially with respect to the annular air passages and which, in operation, sprays fuel into the fuel-air mixing region, and an airflow controller including a movable diverter member for selectively closing the second outer annular air passage and selectively opening a third passage such that air is either admitted into the fuel-air mixing region or is redirected to the third passage leading to the plurality of air-only apertures.

2. The combustion chamber head assembly of claim 1 wherein the movable diverter member of the airflow controller comprises an axially translatable sleeve.

3. The combustion chamber head assembly of claim 2 wherein the axially translatable sleeve cooperates with a coaxial annular flange member to define a flow boundary between the fuel-air mixing region and the enclosed combustor head volume.

4. The combustion chamber head assembly of claim 3 wherein the sleeve comprises an inner annular wall member which forms part of the flow boundary, and an adjoining outer annular wall member which forms part of the air flow controller.

5. The combustion chamber head assembly of claim 4 wherein the outer wall member is provided with a plurality of circumferentially spaced apertures.

6. The combustion chamber head assembly of claim 1 wherein the plurality of concentric rings are profiled to turn the air from a substantially radial flow through 90° into a substantially axial flow in the fuel-air mixing region.

7. The combustion chamber head assembly of claim 1 further comprising an array of air inlet swirl vanes, wherein each air inlet swirl vane is located in an upstream end of one of the first and second air passages.

8. The combustion chamber head assembly of claim 7 wherein said airflow controller acts on the air inlet swirl vanes in the second air passages.

* * * * *